US005277858A

United States Patent [19]

Neal

[11] Patent Number: 5,277,858

[45] Date of Patent: Jan. 11, 1994

[54] PRODUCTION OF HIGH TENACITY, LOW SHRINK POLYESTER FIBER

[75] Inventor: James G. Neal, Raleigh, N.C.

[73] Assignee: AlliedSignal Inc., Morristownship, Morris County, N.J.

[21] Appl. No.: 659,544

[22] Filed: Feb. 22, 1991

Related U.S. Application Data

[63] Continuation-in-part of Ser. No. 499,147, Mar. 26, 1990, abandoned.

[51] Int. Cl.[5] ..... D01D 5/12; D01D 5/16

[52] U.S. Cl. ..... 264/210.8; 264/289.6; 264/290.5; 264/290.7

[58] Field of Search ..... 264/210.8, 289.6, 290.5, 264/290.7

[56] References Cited

U.S. PATENT DOCUMENTS

| | | | |
|---|---|---|---|
| 3,838,561 | 10/1974 | Munting | 264/210.7 X |
| 4,070,432 | 1/1978 | Tamaddon | 264/342 RE |
| 4,101,525 | 7/1978 | Davis et al. | 528/309 |
| 4,251,481 | 2/1981 | Hamlyn | 264/210.3 |
| 4,349,501 | 9/1982 | Hamlyn | 264/210.3 |
| 4,414,169 | 11/1983 | McClary | 264/210.7 |
| 4,529,655 | 7/1985 | Palmer | 428/399 |
| 4,690,866 | 9/1987 | Kumakawa et al. | 428/364 |
| 4,851,172 | 7/1989 | Roman et al. | 264/210.8 |
| 4,956,446 | 9/1990 | Takahashi et al. | 264/210.8 |

*Primary Examiner*—James Lowe

*Attorney, Agent, or Firm*—William H. Thrower

[57] ABSTRACT

In a continuous process for the production of high strength polyester yarn with enhanced low shrinkage the improvement comprising maintaining the traveling yarn about a pair of heated draw rolls for a period of at least 0.25 seconds, maintaining the air temperature in the region about said traveling yarn for said period at a temperature of at least 220° C., said draw rolls each having a surface temperature of at least 220° C. and a substantial portion of its surface with a surface roughness value of at least 50 microinches, whereby said yarn is heated sufficiently to obtain a substantial relaxation between said heated draw rolls and said relaxation roll system, thereby providing enhanced low shrinkage. Polyethylene terephthalate industrial yarn having an intrinsic viscosity of at least 0.78, a dry heat shrinkage $DIN_{177}$ of less than 2.0%, a dry heat shrinkage $DIN_{200}$ of less than 4.5%, and a tenacity of at least 7.2 grams per denier is a part of the invention.

7 Claims, 1 Drawing Sheet

PRODUCTION OF HIGH TENACITY, LOW SHRINK POLYESTER FIBER

BACKGROUND OF THE INVENTION

This is a continuation-in-part of copending U.S. Ser. No. 499,147, filed Mar. 26, 1990, now abandoned. 1. Field of the Invention This invention relates to an improved continuous process for production of an improved polyester yarn having low shrinkage and high tenacity and to the improved polyester yarn per se. The continuous process is an improvement in a coupled process of melt-spinning polymer followed by drawing, heat treating, relaxing and winding.

2. Description of the Related Art

It is known to prepare industrial polyester yarns of somewhat low shrinkage by a continuous process involving spinning, hot-drawing, heat-relaxing, and winding the yarn to form a package in a coupled process. By adjustment of the relaxation conditions, it has been possible to adjust the properties of the-resulting yarn to a limited extent only. By increasing the degree of overfeed during the relaxation, it has been possible to produce yarn of lower residual shrinkage, but this has been accompanied by a significant and undesired decrease in tenacity and modulus. A decrease in residual shrinkage without a significant decrease in tenacity has long been desirable, as demonstrated in U.S. Pat. Nos. 4,251,481 and 4,349,501 to Hamlyn which confirms the difficulty experienced in the prior art in obtaining industrial polyester yarns of desirably low shrinkage without sacrificing strength by a coupled process of spinning, drawing, relaxing, and winding as a continuous operation.

Industrial polyester yarns having a better combination of tenacity and low shrinkage have been obtainable by a split process, i.e., the older 2-stage process of first spinning and winding the yarn to form a package, then drawing and relaxing in a separate operation. This split process is not so economical and a continuous process is preferred.

U.S. Pat. No. 4,070,432 to Tamaddon discloses a continuous process for production of low shrinkage polyester fibers which comprises drawing, then heat treating the drawn filaments over a heated roll system, resulting in improved thermal shrinkage.

U.S. Pat. No. 4,529,655 to Palmer discloses an interlaced polyester yarn having an improved combination of low shrinkage and high tenacity produced by a continuous process which includes a step of heating the yarn and overfeeding it to reduce its shrinkage while interlacing the yarn with heated air (90° to 200° C.) to provide coherency, then winding the yarn to form a package. The resulting yarn is shown in an example to have a dry heat shrinkage (measured at 177° C.) of 3.1% and a dry heat shrinkage (measured at 140° C.) of 1.4%. While offering some improvement, there are applications for industrial polyester fiber, such as reinforcement for roofing materials, which require substantially lower shrinkage at higher temperatures.

SUMMARY OF THE INVENTION

In a continuous process for the production of high strength polyester yarn with enhanced low shrinkage comprising spinning molten polymer of high relative viscosity to form a multifilament yarn, feeding the yarn to a draw roll system to draw the yarn, said draw roll system comprising a pair of heated draw rolls then overfeeding the drawn yarn from said heated draw rolls to a relaxation roll system, thereby reducing its shrinkage, and winding the yarn to form a package in a continuous process, the improvement comprising maintaining the traveling yarn about said pair of heated draw rolls for a period of at least 0.25 seconds, maintaining the air temperature in the region about said traveling yarn for said period at a temperature of at least 220° C., said draw rolls each having a surface temperature of at least 220° C. and a substantial portion of its surface with a surface roughness value of at least 50 microinches, whereby said yarn is heated sufficiently to obtain a substantial relaxation between said heated draw rolls and said relaxation roll system, thereby providing enhanced low shrinkage. Polyethylene terephthalate industrial yarn having an intrinsic viscosity of at least 0.78, a dry heat shrinkage $DIN_{177}$ of less than 2.0%, a dry heat shrinkage $DIN_{200}$ of less than 4.5%, and a tenacity of at least 7.2 grams per denier is a part of the invention.

BRIEF DESCRIPTION OF THE DRAWINGS

FIG. 2 is a schematic front view of an alternative panel with a draw point localizing device for practicing the process of this invention.

DESCRIPTION OF THE PREFERRED EMBODIMENT

Figure 1:
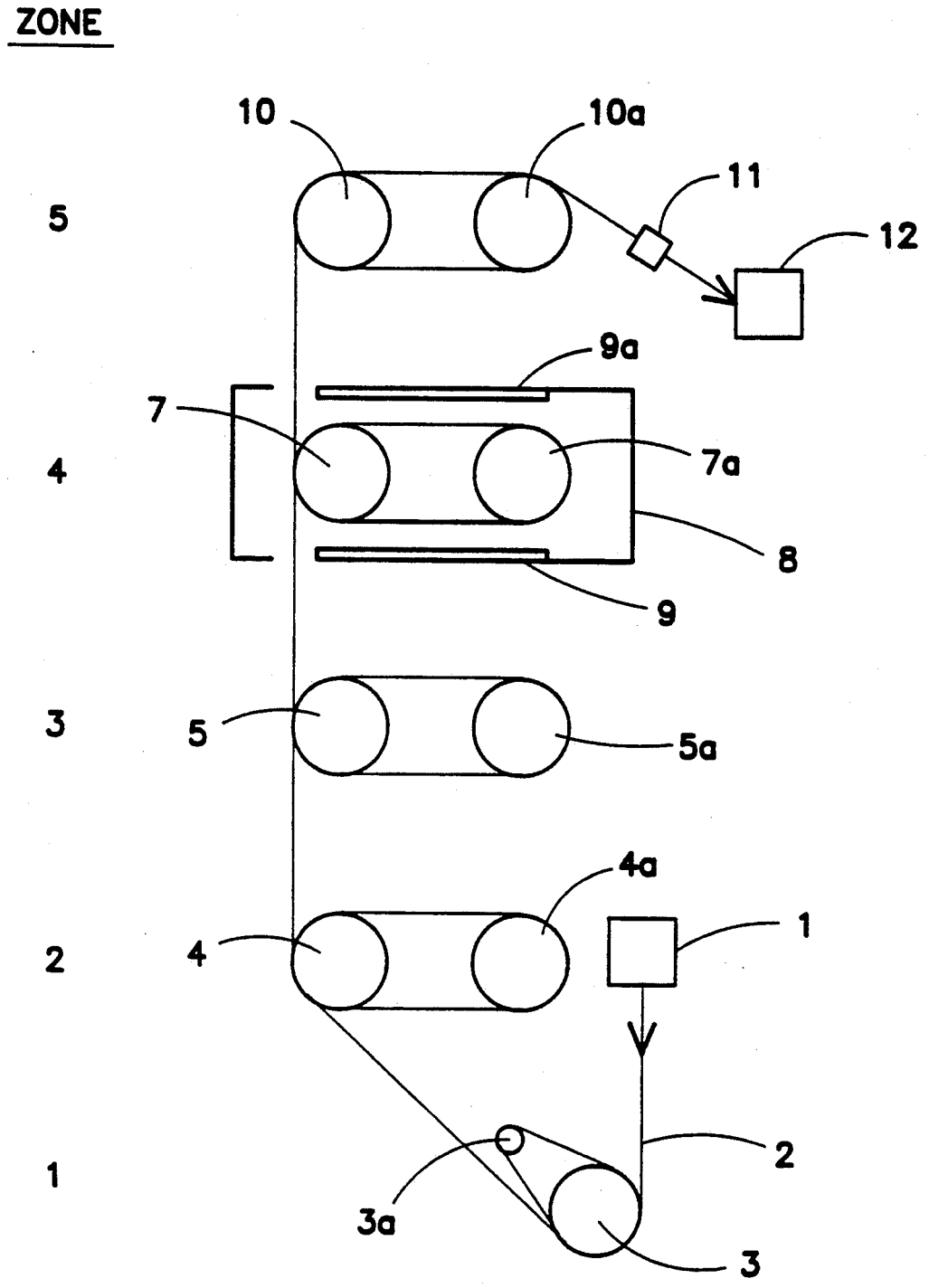
FIG. 1 is a schematic front view of the draw panel for practicing the process of this invention.

With reference to FIG. 1, multifilament yarn 2 is spun from molten polymer and quenched in known ways such as taught by U.S. Pat. No. 4,251,481 to Hamlyn, incorporated herein by reference. These known spinning and quenching steps are represented by the box labeled 1 in FIG. 1. The yarn 2 is continuously fed to wrap around unheated pretension roll 3, and accompanying separator roll 3*a* (Zone 1) and then to a pair of heated feed rolls 4, 4*a* (Zone 2). From feed rolls 4, 4*a*, the yarn is passed to a first pair of heated draw rolls 5 and 5*a* (Zone 3). The yarn end is then passed to around heated draw/relax rolls 7 and 7*a* (Zone 4) which are contained within enclosure 8. The purpose of enclosure 8 is to maintain the air within the enclosure which is in contact with the traveling yarn at a temperature of at least 200° C., preferably at least 220° C. The surface temperature of draw/relax rolls 7, 7*a*, must be monitored at a temperature of at least 200° C., preferably at least 220° C. To this end, heated plates 9 and 9*a* can be utilized to add heat to the enclosure if it is necessary. The yarn end is then passed from draw/relax rolls 7, 7*a* to relaxation rolls 10, 10*a* (Zone 5) then through conventional compacting jet 11 to conventional winding means 12.

FIG. 2 provides a preferred alternative process where yarn end 2 is passed from unheated feed rolls 4, 4*a* through a conventional steam impinging draw point localizing jet 6, preferably supplying steam at a temperature of about 320° C. to 550° C. for example about 520° C. and at a pressure of about 75 to 125 psig, to heated draw/relax rolls 7, 7*a*.

An important preferred aspect of the invention is the use of draw/relax rolls 7, 7*a* with a surface roughness of at least 50 microinches which permit a degree of relaxation to occur during yarn residence on those rolls within the heated enclosure. The surface roughness value (Ra) for the draw/relax rolls should be at least 50 microinches, preferably between 50 and 90 microinches. Roughness values are measured by a Bendix Profilometer Type VE Model 14. It is preferred that relaxation rolls 10 and 10*a*, feed rolls 4 and 4*a*, and draw rolls 5 and 5*a* have a Ra of 35 to 80 microinches. The preferred draw/relax rolls are intended to include matte chrome rolls, coated rolls such as flame sprayed oxide coated rolls (i.e. LA-7), and the zebra rolls exemplified below in Example 3 which include substantial bands of matte chrome finish at the rear of the roll (relative to its position on the draw panel) and at the front of the roll with a band of bright chrome between the matte surfaces.

With respect to the temperatures at which the various rolls are maintained, the primary objective is to obtain a yarn temperature within the heated enclosure 8 at as high as practicable without melting the yarn or causing the yarn to stick to the rolls. It is preferred that-yarn be maintained within the enclosure 8 on draw/relax rolls 7, 7*a* for a residence time of at least 0.25 seconds, more . preferably 0.25 to 0.50 seconds.

Yarns comparable to the prior art can be made by the process of this invention with a relaxation from the draw/relax rolls to the relaxation rolls of for example about 10%. Preferred yarns of the invention with a dry heat shrinkage $DIN_{177}$ of less than 2.0% and a dry heat shrinkage $DIN_{200}$ of less than 4.5% can be made with a relaxation of at least 12%, preferably at least 13%. Relaxation is expressed as a percentage decrease in length from the draw/relax rolls to the take-up winder.

The polyester yarn of the invention contains at least 90 mol percent polyethylene terephthalate (PET). In a preferred embodiment, the polyester is substantially all polyethylene terephthalate. Alternatively, the polyester may incorporate as copolymer units minor amounts of units derived from one or more ester-forming ingredients other than ethylene glycol and terephthalic acid or its derivatives. Illustrative examples of other ester-forming ingredients which may be copolymerized with the polyethylene terephthalate units include glycols such as diethylene glycol, trimethylene glycol, tetramethylene glycol, hexamethylene glycol, etc., and dicarboxylic acids such as isophthalic acid, hexahydroterephthalic acid, bibenzoic acid, adipic acid, sebacic acid, azelaic acid.

The multifilament yarn of the present invention commonly possesses a denier per filament of about 1 to 20(e.g. about 3 to 10), and commonly consists of about 6 to 600 continuous filaments (e.g. about 20 to 400 continuous filaments). The denier per filament and the number of continuous filaments present in the yarn may be varied widely as will be apparent to those skilled in the art.

The multifilament yarn is particularly suited for use in industrial applications in environments where elevated temperatures are encountered such as reinforcement for roofing materials. The filamentary. material undergoes a relatively low degree of shrinkage for a high strength fibrous material.

Intrinsic viscosity (IV) of the polymer and yarn is a convenient measure of the degree of polymerization and molecular weight. IV is determined by measurement of relative solution viscosity of PET sample in a mixture of phenol and tetrachloroethane (60/40 by weight) solvents.

Satisfactory drawn yarns with IV of at least 0.78, for example 0.80 to 0.90 can be obtained by this invention.

The tenacity values (i.e. at least 7.2 grams per denier, preferably 7.5 to 8.5 grams per denier), compare favorably with these particular parameters exhibited by commercially available yarns. The tensile properties referred to herein were determined on yarns conditioned for two hours through the utilization of an Instron tensile tester (Model TM) using a 10-inch gauge length and a strain rate of 120 percent per minute in accordance with ASTM D885. All tensile measurements were made at room temperature. The tenacity of breaking strength in grams per denier (UTS) is the maximum resultant internal force that resists rupture in a tension test, or breaking load or force, expressed in units of weight required to break or rupture a specimen in a tensile test made according to specified standard procedure. By "UE, %" is meant elongation at break in percent.

Dry heat shrinkages (DIN) are determined by exposing a measured length of yarn under zero tension to dry heat for 30 minutes in an oven maintained at the indicated temperatures (177° C. for $DIN_{177}$ and 200° C. for $DIN_{200}$) and by measuring the change in length. The shrinkages are expressed as percentages of the original length. $DIN_{177}$ has been most frequently measured for industrial yarn but I have found $DIN_{200}$ to provide an important indication of shrinkage for applications requiring good dimensional stability at higher temperatures.

The term "free shrinkage" is defined as percent decrease in length of the yarn when exposed in an oven to 177° C. for 2 minutes under 0.009 gpd tension.

In the following examples yarn was produced by spinning from a melt of polyethylene terephthalate under spinning and quenching conditions of example 1 of U.S. Pat. No. 4,251,481 to Hamlyn, including application of a spin finish. The examples represent the subsequent drawing and heat treatment steps provided on the panels illustrated in FIGS. 1 and 2.

Example 1

With reference to FIG. 1, a trial was run without the heated enclosure 8, which was removed from the panel. The following process conditions were used:

| Zone | Roll Surface RMS, L/R | Roll Speed meter per minute | Roll Temp. °C. |
|---|---|---|---|
| 5 | 50/57 | 2059.3 to 2243.7 | 100/100 |
| 4 | 50/62 | 2313.6 | 220/220 |
| 3 | 67/52 | 1575.8 | 140/140 |
| 2 | 66/67 | 394.0 | 100/100 |
| 1 | 30 | 386.2 | Ambient |

Yarn residence time at zone 4 was 0.3600 seconds. The Zone 5 relaxation rolls were varied in speed from 2059.3 to 2243.7 to provide samples of yarn of from 3 to 11% relaxation. The maximum relaxation at which the process would operate without breaking out was determined to be 11%. Yarn of 0.88 intrinsic viscosity was produced. The following properties were obtained.

| Trial | % Relax | UE % | UTS, gpd | Free SHRINKAGE @ 177° C. | DIN SHRINKAGE @ 177° C. |
|---|---|---|---|---|---|
| I-A | 3.0 | 10.2 | 9.27 | 13.3 | |
| B | 4.0 | 13.0 | 8.72 | 12.6 | |
| C | 5.0 | 13.8 | 8.58 | 10.7 | |
| D | 6.0 | 14.5 | 8.79 | 9.9 | |
| E | 7.0 | 16.4 | 8.77 | 9.8 | |
| F | 8.0 | 16.8 | 8.58 | 8.5 | |

-continued

| Trial | % Relax | UE % | UTS, gpd | Free SHRINKAGE @ 177° C. | DIN SHRINKAGE @ 177° C. |
|---|---|---|---|---|---|
| G | 9.0 | 18.0 | 8.62 | 7.0 | |
| H | 10.0 | 19.7 | 8.40 | 7.0 | |
| I | 11.0 | 21.6 | 8.36 | 5.8 | 6.4 |

Example 2

With reference to FIG. 1, a trial was run with the following process conditions.

| Zone | Roll Surface RMS, L/R | Roll Speed meter per minute | Roll Temp. °C. |
|---|---|---|---|
| 5 | 50/57 | 1911.3 to 2083.2 | 100/100 |
| 4 | 50/62 | 2289.1 | 220/220 |
| 3 | 67/52 | 1708.3 | 140/140 |
| 2 | 66/67 | 401.7 | 100/100 |
| 1 | 30 | 393.9 | Ambient |

The residence time at zone 4 was 0.3639. The heater plates 9 and 9*a* at zone 4 were maintained at 230° C.

Yarn of 0.88 intrinsic viscosity was produced. The following yarn properties were obtained:

| Trial | % Relax | UE % | UTS, gpd | Free SHRINKAGE @ 177° C. | DIN SHRINKAGE @ 177° C. |
|---|---|---|---|---|---|
| II-A | 9.0 | 22.1 | 8.02 | 5.2 | 5.8 |
| B | 10.0 | | | | |
| C | 10.5 | 23.6 | 8.02 | 4.2 | 4.8 |
| D | 11.0 | 24.5 | 7.93 | 3.8 | 4.4 |
| E | 11.5 | 25.5 | 7.84 | 3.6 | 4.2 |
| F | 12.0 | 26.6 | 7.66 | 3.0 | 3.6 |
| G | 12.5 | 26.0 | 7.76 | 3.0 | 3.6 |
| H | 13.0 | 27.0 | 7.46 | 2.4 | 3.0 |
| I | 13.5 | 28.9 | 7.58 | 2.4 | 3.0 |
| J | 14.0 | 27.5 | 7.43 | 1.9 | 2.5 |
| K | 14.5 | 29.7 | 7.38 | 1.8 | 2.4 |
| L | 15.0 | 30.0 | 7.45 | 1.4 | 1.9 |
| M | 15.5 | 31.4 | 7.39 | 1.1 | 1.6 |
| N | 16.0 | 31.6 | 7.38 | 1.1 | 1.6 |
| O | 16.5 | 32.4 | 7.34 | 0.9 | 1.4 |
| P | 17.0 | 33.5 | 7.32 | 1.1 | 1.6 |

Example 3

The trial of example 2 was repeated with a difference in rolls. The two rolls in zone 4 were changed to zebra rolls with three inches of matte chrome (86 RMS) at the rear of the roll and two inches of matte chrome (86 RMS) at the front, with 7 inches of bright chrome (7 RMS) between the matte surfaces. The objective was to determine if bright chrome rolls gave better heat transfer than matte chrome rolls. All other process conditions were as provided in example 2. Yarn of 0.88 intrinsic viscosity was produced The following yarn properties were obtained:

| Trial | % Relax | UE % | UTS, gpd | Free SHRINKAGE @ 177° C. | DIN SHRINKAGE @ 177° C. |
|---|---|---|---|---|---|
| III-A | 12.0 | 25.4 | 7.37 | 4.5 | 5.1 |
| B | 12.5 | 24.4 | 7.24 | 2.6 | 3.2 |
| C | 13.0 | 26.8 | 7.36 | 2.4 | 3.0 |
| D | 13.5 | 26.5 | 7.17 | 2.2 | 2.8 |
| E | 14.0 | 28.0 | 7.35 | 2.0 | 2.6 |
| F | 14.5 | 28.3 | 7.23 | 1.8 | 2.4 |
| G | 15.0 | 31.7 | 7.06 | 1.6 | 2.1 |
| H | 15.5 | 30.5 | 7.14 | 1.4 | 1.9 |
| I | 16.0 | 32.8 | 7.11 | 1.2 | 1.7 |
| J | 16.5 | 30.3 | 6.73 | 1.1 | 1.6 |
| K | 17.0 | 31.0 | 6.96 | 1.0 | 1.5 |
| L | 17.5 | 33.3 | 6.70 | 1.2 | 1.7 |
| M | 18.0 | 34.1 | 6.84 | 1.1 | 1.6 |
| N | 18.5 | 34.1 | 6.41 | 0.6 | 1.1 |
| O | 19.0 | 35.5 | 6.24 | 0.7 | 1.2 |
| P | 19.5 | 38.5 | 6.62 | 0.7 | 1.2 |

The yarn properties of this example are similar to example 2except the tenacity was approximately 0.15 gpd lower. Higher percent relaxation was used in this example, but most likely could have been used in example 2.

Example 4

Yarn was produced utilizing a single stage draw process with a draw point localizing device (DPL) such as shown in FIG. 2. Roll 3 (Zone 1) was unheated (ambient) polished chrome. In Zone 2, roll 4 and 4*a* were unheated polished chrome. In Zone 3 rolls 7 and 7*a* were LA-7 (surface roughness 70 microinches) heated to the specified temperature. Rolls 10 and 10*a* were unheated matte chrome. In all the trials except trial 2, the heater plates 9 and 9*a* were heated to a temperature of 350° C. In trial 2 the heater plates were not heated. The following process conditions were utilized.

EXAMPLE 4 - PROCESS CONDITIONS

| TRIAL | ROLL SPEED MPM ZONE 1 | ROLL SPEED MPM ZONE 2 | ROLL SPEED MPM ZONE 3 | ZONE 3 ROLL TEMP. °C. | RESIDENCE TIME (SEC) ZONE 3 ENCLOSURE | DRAW RATIO DR1 × DR2 | % RELAX ZONE 3 TO ZONE 4 | ROLL SPEED ZONE 4 MPM | TOTAL DRAW RATIO |
|---|---|---|---|---|---|---|---|---|---|
| IV-0 | 357.2 | 359.2 | 2298.9 | 230/230 | .4936 | 6.432 | 13.0 | 2000 | 5.596 |
| 1 | " | " | " | " | .3455 | " | " | " | " |
| 2 | " | " | " | " | " | " | " | " | " |
| 3 | 345.2 | 347.2 | 2222.2 | 195/195 | .3574 | " | 10.0 | " | 5.789 |
| 4-1 | 467.2 | 469.4 | 2957.5 | 240/240 | .2686 | 6.332 | 13.0 | 2573 | 5.509 |
| 4-2 | " | " | " | " | " | " | " | " | " |
| 4-3 | 472.9 | 474.9 | 2991.9 | " | .2654 | " | 14.0 | " | 5.446 |
| 5 | 467.2 | 469.4 | 2957.5 | 225/225 | .2686 | " | 13.0 | " | 5.509 |
| 6-1 | " | " | " | 210/210 | " | " | " | " | " |
| 6-2 | " | " | " | " | .1535 | " | " | " | " |
| 7 | " | " | " | 240/240 | .2686 | " | " | " | " |
| 8-1 | " | " | " | 210/210 | " | " | " | " | " |
| 8-2 | " | " | " | " | .1535 | " | " | " | " |
| 11-1 | " | " | " | 240/240 | .2686 | " | " | " | " |
| 11-2 | 460.1 | 462.1 | " | " | " | 6.432 | " | " | 5.596 |
| 11-3 | 471.0 | 473.0 | 3027.1 | " | .2623 | " | 15.0 | " | 5.467 |
| 11-4 | 460.1 | 462.1 | 2957.5 | " | .1535 | " | 13.0 | " | 5.596 |

-continued

EXAMPLE 4 - PROCESS CONDITIONS

| TRIAL | ROLL SPEED MPM ZONE 1 | ZONE 2 | ZONE 3 | ZONE 3 ROLL TEMP. °C. | RESIDENCE TIME (SEC) ZONE 3 ENCLOSURE | DRAW RATIO DR1 × DR2 | % RELAX ZONE 3 TO ZONE 4 | ROLL SPEED ZONE 4 MPM | TOTAL DRAW RATIO |
|---|---|---|---|---|---|---|---|---|---|
| 12-1 | 467.4 | 469.4 | " | 225/225 | .2686 | 6.332 | " | " | 5.509 |
| 12-2 | 460.1 | 462.1 | " | " | " | 6.432 | " | " | 5.596 |
| 12-3 | 471.0 | 473.0 | 3027.1 | " | .2623 | " | 15.0 | " | 5.467 |
| 12-4 | 460.1 | 462.1 | 2957.5 | " | .1535 | " | 13.0 | " | 5.596 |
| 13-1 | " | " | " | 210/210 | .2686 | " | " | " | " |
| 13-2 | 471.0 | 473.0 | 3027.1 | " | .2623 | " | 15.0 | " | 5.467 |
| 13-3 | 460.1 | 462.1 | 2957.5 | " | .1535 | " | 13.0 | " | 5.596 |
| 14-1 | " | " | " | 225/225 | .2686 | " | " | " | " |
| 14-2 | 471.0 | 473.0 | 3027.1 | " | .2623 | " | 15.0 | " | 5.467 |
| 14-3 | 460.1 | 462.1 | 2957.5 | " | .1535 | " | 13.0 | " | 5.596 |
| 15-1 | " | " | " | " | .2686 | " | 10.0 | 2661.8 | 5.789 |
| 15-2 | " | " | " | " | " | " | 5.0 | 2809.6 | 6.110 |
| 15-3 | " | " | " | " | " | " | 0 | 2957.5 | 6.432 |
| 16-1 | " | " | " | 210/210 | " | " | 10.0 | 2661.8 | 5.789 |
| 16-2 | " | " | " | " | " | " | 5.0 | 2809.6 | 6.110 |
| 16-3 | " | " | " | " | " | " | 0 | 2957.5 | 6.432 |
| 17-1 | " | " | " | 225/225 | " | " | 13.0 | 2573 | 5.596 |
| 17-2 | 471.0 | 473.0 | 3027.1 | " | .2623 | " | 15.0 | " | 5.467 |
| 17-3 | 460.1 | 462.1 | 2957.5 | " | .1535 | " | 13.0 | " | 5.596 |
| 18-1 | " | " | " | " | .2686 | " | " | " | " |
| 18-2 | " | " | " | " | .1535 | " | " | " | " |
| 18-3 | " | " | " | " | .1151 | " | " | " | " |
| 18-4 | " | " | " | " | .0768 | " | " | " | " |

For the above trial 0 to 8-2, yarn of 0.86 intrinsic viscosity was produced. For trials 11-1 to 18-4, yarn of 0.82 intrinsic viscosity was produced. The following physical properties were obtained:

| Trial | UE, % | UTS, gpd | Free Shrinkage @ 177° C. | DIN Shrinkage @ 177° C. | DIN Shrinkage @ 200° C. |
|---|---|---|---|---|---|
| IV-0 | 23.8 | 8.19 | 0.8 | 1.3 | 2.95 |
| 1 | 23.2 | 7.64 | 0.9 | 1.4 | |
| 2 | 22.8 | 7.73 | 1.0 | 1.5 | |
| 3 | 19.2 | 8.25 | 1.8 | 2.4 | 5.71 |
| 4-1 | 21.0 | 7.46 | 1.5 | 2.0 | |
| 4-2 | 21.6 | 7.41 | 1.3 | 1.8 | |
| 4-3 | 21.9 | 7.17 | 1.3 | 1.8 | |
| 5 | 22.2 | 8.05 | 1.0 | 1.5 | 3.81 |
| 6-1 | 22.1 | 8.07 | 1.0 | 1.5 | |
| 6-2 | 22.1 | 7.78 | 1.4 | 1.9 | |
| 7 | 20.6 | 7.65 | 1.7 | 2.3 | |
| 8-1 | 22.1 | 8.02 | 1.6 | 2.1 | |
| 8-2 | 20.6 | 8.18 | 1.1 | 1.6 | |
| 11-1 | 21.7 | 6.93 | 1.3 | 1.8 | |
| 11-2 | 21.1 | 7.02 | 1.5 | 2.0 | |
| 11-3 | 23.1 | 6.87 | 1.1 | 1.6 | |
| 11-4 | 21.2 | 7.32 | 1.6 | 2.1 | |
| 12-1 | 21.6 | 7.64 | 1.1 | 1.6 | |
| 12-2 | 22.0 | 7.37 | 0.9 | 1.4 | 4.02 |
| 12-3 | 23.7 | 7.34 | 0.9 | 1.4 | |
| 12-4 | 22.4 | 7.88 | 1.6 | 2.1 | |
| 13-1 | 20.7 | 7.73 | 1.2 | 1.7 | |
| 13-2 | 23.5 | 7.52 | 0.9 | 1.4 | |
| 13-3 | 21.9 | 7.80 | 1.5 | 2.0 | |
| 14-1 | 20.4 | 7.60 | 1.2 | 1.7 | |
| 14-2 | 23.2 | 7.33 | 0.9 | 1.4 | 2.91 |
| 14-3 | 21.2 | 7.60 | 1.2 | 1.7 | |
| 17-1 | 21.6 | 7.46 | 1.0 | 1.5 | |
| 17-2 | 23.3 | 7.09 | 0.9 | 1.4 | |
| 17-3 | 21.3 | 7.23 | 1.5 | 2.0 | |
| 18-1 | 21.9 | 8.08 | 1.1 | 1.6 | |
| 18-2 | 22.0 | 8.01 | 1.3 | 1.8 | |
| 18-3 | 21.2 | 7.74 | 1.4 | 1.9 | |
| 18-4 | 20.4 | 7.87 | 1.9 | 2.5 | |

Example 5

Yarn was produced on the draw panel represented by FIG. 1. Roll 3 was unheated polished chrom. Rolls 4 and 4*a* were matte chrome at 125° C. surface temperature. Rolls 5 and 5*a* were LA-7 at 150° C. Rolls 7 and 7*a* were matte chrome at 225° C. The heater plates 9 and 9*a* were not heated for the enclosures. Rolls 10 and 10*a* were unheated matte chrome operated for all trials at 2400 meters per minute. Additional process conditions are as follows:

EXAMPLE 5. PROCESS CONDITIONS

| Trial | ROLL SPEED MPM ZONE 1 | ZONE 2 | ZONE 3 | ZONE 4 | RESIDENCE TIME (SEC) ZONE 4 ENCLOSURE |
|---|---|---|---|---|---|
| V-16 | 469.5 | 474.1 | 1896.6 | 2727.3 | .2883 |
| 17 | 474.8 | 479.6 | 1918.4 | 2758.6 | .2880 |
| 18 | 459.0 | 463.6 | 1854.5 | 2666.7 | .2978 |
| 19 | 440.0 | 444.5 | 1777.8 | " | " |
| 20 | 425.8 | 430.1 | 1720.5 | " | " |
| 21 | 436.6 | 440.9 | 1763.7 | " | " |
| 22 | 450.0 | 454.6 | 1818.2 | 2727.3 | .2883 |
| 23 | 460.5 | 465.1 | 1860.5 | 2790.7 | .2846 |
| 24 | 416.9 | 421.1 | 1684.2 | 2526.3 | .3143 |

| Trial | % RELAX ZONE 4 TO 5 | DRAW RATIO DR1 × DR2 × DR3 | TOTAL DRAW RATIO |
|---|---|---|---|
| V-16 | 12.0 | 5.809 | 5.112 |
| 17 | 13.0 | 5.810 | 5.055 |
| 18 | 10.0 | 5.810 | 5.229 |
| 19 | " | 6.061 | 5.455 |
| 20 | " | 6.263 | 5.636 |
| 21 | " | 6.108 | 5.497 |
| 22 | 12.0 | 6.061 | 5.333 |
| 23 | 14.0 | 6.060 | 5.218 |
| 24 | 5.0 | 6.060 | 5.757 |

The following physical properties were obtained:

| Trial | UE, % | UTS gpd | Free Shrinkage @ 177° C. | DIN Shrinkage @ 177° C. |
|---|---|---|---|---|
| V-16 | 22.8 | 8.01 | 1.8 | 2.4 |
| 17 | 23.6 | 7.95 | 1.4 | 1.9 |
| 18 | 21.4 | 7.33 | 2.5 | 3.1 |
| 19 | 20.2 | 7.93 | 2.7 | 3.3 |
| 20 | 20.1 | 8.56 | 3.3 | 3.9 |

-continued

| Trial | UE, % | UTS gpd | Free Shrinkage @ 177° C. | DIN Shrinkage @ 177° C. |
|---|---|---|---|---|
| 21 | 19.6 | 8.26 | 3.0 | 3.6 |
| 22 | 21.7 | 7.72 | 2.0 | 2.6 |
| 23 | 25.4 | 7.74 | 1.1 | 1.6 |
| 24 | 15.6 | 8.40 | 7.0 | 7.7 |

What is claimed is:

1. In a continuous process for the production of high strength polyester yarn with enhanced low shrinkage comprising spinning molten polymer of high relative viscosity to form a multifilament yarn, feeding the yarn to a draw roll system to draw the yarn, said draw roll system comprising a pair of heated draw rolls, then overfeeding the drawn yarn from said heated draw rolls to a relaxation roll system, thereby reducing its shrinkage, and winding the yarn to form a package in a continuous process, the improvement comprising maintaining the traveling yarn about said pair of heated draw rolls for a sufficient period, maintaining the air temperature in the region about said traveling yarn for said period at a temperature of at least 200° C. said draw rolls each having a surface temperature of at least 200° C., whereby said yarn is heated sufficiently to obtain a substantial relaxation between said heated draw rolls and said relaxation roll system, thereby providing yarn having an intrinsic viscosity of at least 0.78, a dry heat shrinkage $DIN_{177}$ of less than 2.0A%, a dry heat shrinkage $DIN_{200}$ of less than 4.5, and a tenacity of at least 7.2 grams per denier.

2. The process of claim 1 wherein the air temperature about the traveling yarn is maintained about said pair of heated draw rolls by the presence of a heated box.

3. The process of claim 2 wherein the air temperature adjacent to said yarn is heated by heated plates.

4. The process of claim 1 wherein the traveling yarn is maintained about said pair of heated draw rolls for a period of 0.25 to 0.50 seconds and the yarn is heated sufficiently to obtain said substantial relaxation of at least 10%.

5. The process of claim 4 wherein said yarn is heated sufficiently to obtain said substantial relaxation of at least 12%.

6. The process of claim 5 wherein said yarn is heated sufficiently to obtain said substantial relaxation of at least 13%.

7. In a continuous process for the production of high strength polyester yarn with enhanced low shrinkage comprising spinning molten polymer of high relative viscosity to form a multifilament yarn, feeding the yarn to a draw roll system to draw the yarn, said draw roll system comprising a pair of heated draw rolls, then overfeeding the drawn yarn from said heated draw rolls to a relaxation roll system, thereby reducing its shrinkage, and winding the yarn to form a package in a continuous process, the improvement comprising maintaining the traveling yarn about said pair of heated draw rolls for a period of at lest 0.25 seconds, maintaining the air temperature in the region about said traveling yarn for said period at a temperature of at least 220° C., said draw rolls each having a surface temperature of at least 220° C. and a substantial portion of its surface with a surface roughness value of at least 50 microinches, whereby said yarn is heated sufficiently to obtain a substantial relaxation between said heated draw rolls and said relaxation roll system, thereby providing yarn having an intrinsic viscosity of at least 0.78, a dry heat shrinkage $DIN_{177}$ of less than 2.0%, a dry heat shrinkage $DIN_{200}$ of less than 4.5, and a tenacity of at least 7.2 grams per denier.

* * * * *

UNITED STATES PATENT AND TRADEMARK OFFICE

CERTIFICATE OF CORRECTION

PATENT NO. : 5,277,858

DATED : January 11, 1994

INVENTOR(S) : James G. Neal

It is certified that error appears in the above-identified patent and that said Letters Patent is hereby corrected as shown below:

Col. 9, line 32, "2.0A%" should read --2.0%--

Signed and Sealed this

Twenty-fourth Day of May, 1994

Bruce Lehman

*Attest:*

BRUCE LEHMAN

*Attesting Officer*

*Commissioner of Patents and Trademarks*